US011837243B2

(12) United States Patent
Tu et al.

(10) Patent No.: US 11,837,243 B2
(45) Date of Patent: Dec. 5, 2023

(54) PROCESSING METHOD OF SOUND WATERMARK AND SPEECH COMMUNICATION SYSTEM

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW)

(73) Assignee: Acer Incorporated, New Taipei (TW)

( * ) Notice: Subject to any disclaimer, the term of this patent is extended or adjusted under 35 U.S.C. 154(b) by 165 days.

(21) Appl. No.: 17/402,631

(22) Filed: Aug. 16, 2021

(65) Prior Publication Data

US 2023/0019841 A1 Jan. 19, 2023

(30) Foreign Application Priority Data

Jul. 13, 2021 (TW) ..... 110125761

(51) Int. Cl.
*G10L 19/018* (2013.01)
*G10L 13/02* (2013.01)

(52) U.S. Cl.
CPC ..... *G10L 19/018* (2013.01); *G10L 13/02* (2013.01)

(58) Field of Classification Search
CPC ..... G10L 19/018; G10L 13/02
See application file for complete search history.

(56) References Cited

U.S. PATENT DOCUMENTS 7,299,189 B1 * 11/2007 Sato ..... G10L 19/0212 704/E19.009
2004/0267533 A1 * 12/2004 Hannigan ..... G06T 1/0028 375/E7.089
2006/0212704 A1 * 9/2006 Kirovski ..... H04L 9/32 704/E19.009
2008/0181449 A1 7/2008 Hannigan et al.
2013/0085751 A1 * 4/2013 Takahashi ..... G10L 19/018 704/226
2014/0108020 A1 * 4/2014 Sharma ..... G10L 19/018 704/500
2016/0148620 A1 * 5/2016 Bilobrov ..... G10L 25/54 704/270
2021/0098008 A1 * 4/2021 Nesfield ..... G10L 19/018

FOREIGN PATENT DOCUMENTS

CN 102884571 12/2014

* cited by examiner

*Primary Examiner* — Pierre Louis Desir
*Assistant Examiner* — Keisha Y. Castillo-Torres
(74) *Attorney, Agent, or Firm* — JCIPRNET

(57) ABSTRACT

A processing method of a sound watermark and a speech communication system are provided. Multiple sinewave signals are generated. Frequencies of the sinewave signals are different from each other, and the sinewave signals belong to a high-frequency sound signal. A watermark pattern is mapped into a time-frequency diagram, to form a watermark sound signal. Two dimensions of the watermark pattern in a two-dimensional coordinate system respectively correspond to a time axis and a frequency axis in the time-frequency diagram. Each of multiple audio frames on the time axis corresponds to the sinewave signals with different frequencies on the frequency axis. A speech signal and the watermark sound signal are synthesized in a time domain to generate a watermark-embedded signal. Accordingly, a sound watermark may be embedded in real-time.

16 Claims, 8 Drawing Sheets

PROCESSING METHOD OF SOUND WATERMARK AND SPEECH COMMUNICATION SYSTEM

CROSS-REFERENCE TO RELATED APPLICATION

This application claims the priority benefit of Taiwan application serial no. 110125761, filed on Jul. 13, 2021. The entirety of the above-mentioned patent application is hereby incorporated by reference herein and made a part of this specification.

BACKGROUND

Technical Field

The disclosure relates to a speech processing technology, and more particularly, to a processing method of a sound watermark and a speech communication system.

Description of Related Art

Remote conferences allow people in different locations or spaces to have conversations, and conference-related equipment, protocols, and/or applications are also well developed. It is worth noting that some real-time conference programs may synthesize speech signals and watermark sound signals. However, the embedding process of the watermark may take too much time, which is more difficult to meet the immediacy of the conference call. In addition, the sound signal may be affected by noise and be distorted after transmission, and the embedded watermark will also be affected and difficult to recognize.

SUMMARY

In view of this, the embodiments of the disclosure provide a processing method of a sound watermark and a speech communication system, which may embed a watermark sound signal in real time, and also has an anti-noise function.

The processing method of the sound watermark in the embodiment of the disclosure includes (but is not limited to) the following steps. Multiple sinewave signals are generated. Frequencies of the sinewave signals are different, and the sinewave signals belong to a high-frequency sound signal. A watermark pattern is mapped into a time-frequency diagram to form a watermark sound signal. Two dimensions of the watermark pattern in a two-dimensional coordinate system respectively correspond to a time axis and a frequency axis in the time-frequency diagram. Each of multiple audio frames on the time axis corresponds to the sinewave signals with different frequencies on the frequency axis. A speech signal and the watermark sound signal are synthesized in a time domain to generate a watermark-embedded signal.

The speech communication system in the embodiment of the disclosure includes (but is not limited to) a transmitting device. The transmitting device is configured to generate multiple sinewave signals, map a watermark pattern into a time-frequency diagram to form a watermark sound signal, and synthesize a speech signal and the watermark sound signal in a time domain to generate a watermark-embedded signal. Frequencies of the sinewave signals are different, and the sinewave signals belong to a high-frequency sound signal. Two dimensions of the watermark pattern in a two-dimensional coordinate system respectively correspond to a time axis and a frequency axis in the time-frequency diagram. Each of multiple audio frames on the time axis corresponds to the sinewave signals with different frequencies on the frequency axis.

Based on the above, according to the speech communication system and the processing method of the sound watermark in the embodiments of the disclosure, the sinewave signals belonging to the high-frequency sound and having different frequencies are used to synthesize the watermark sound signal corresponding to the watermark pattern, and the watermark sound signal and the speech signal are synthesized in the time domain. In this way, the watermark sound signal may be embedded in real time, and the noise impact of the pulse signal may be reduced.

In order for the aforementioned features and advantages of the disclosure to be more comprehensible, embodiments accompanied with drawings are described in detail below

DETAILED DESCRIPTION OF DISCLOSED EMBODIMENTS

Figure 1:
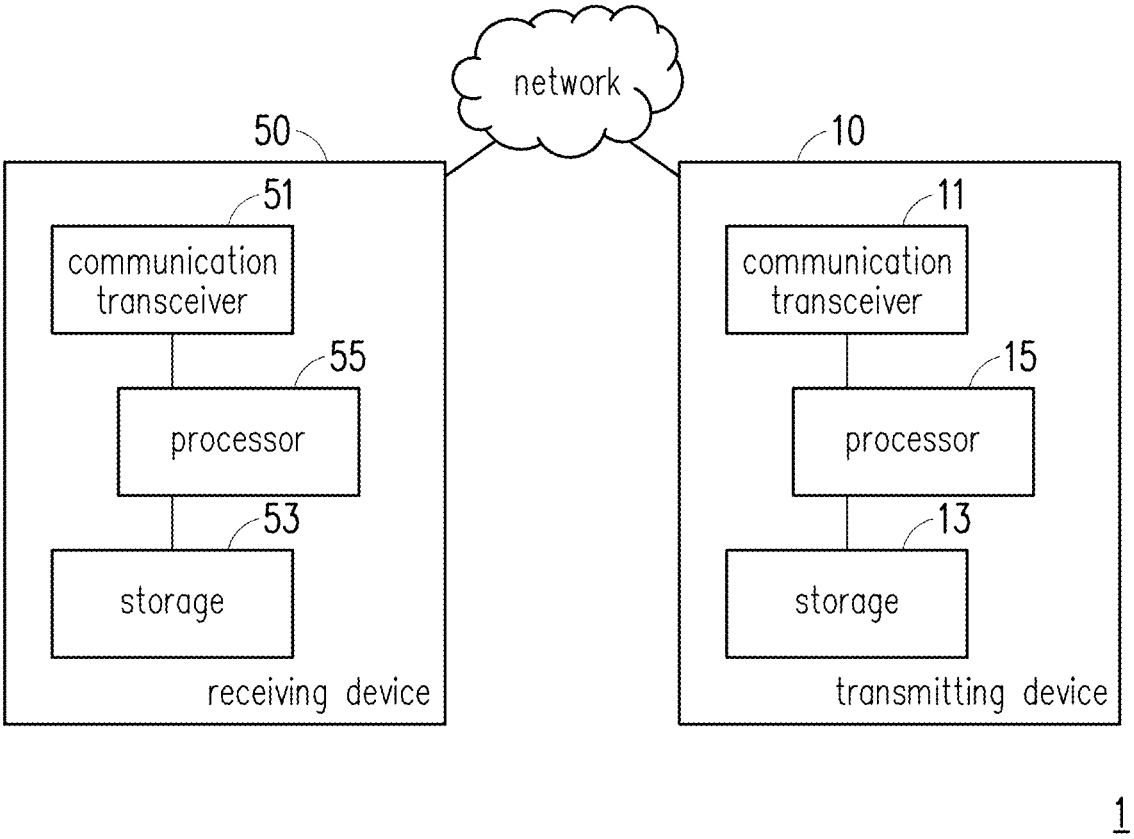
FIG. 1 is a block diagram of components of a speech communication system according to an embodiment of the disclosure.

FIG. 1 is a block diagram of components of a speech communication system 1 according to an embodiment of the disclosure. Referring to FIG. 1, the speech communication system 1 includes, but is not limited to, one or more transmitting devices 10 and one or more receiving devices 50.

The transmitting device 10 and the receiving device 50 may be wired phones, mobile phones, Internet phones, tablet computers, desktop computers, notebook computers, or smart speakers.

The transmitting device 10 includes (but is not limited to) a communication transceiver 11, a storage 13 and a processor 15.

The communication transceiver 11 is, for example, a transceiver (which may include (but is not limited to) a component such as a connection interface, a signal converter, and a communication protocol processing chip) that supports a wired network such as Ethernet, an optical fiber network, or a cable, and may also be a transceiver (which may include (but is not limited to) a component such as an antenna, a digital-to-analog/analog-to-digital converter, and a communication protocol processing chip) that supports a wireless network such as Wi-Fi, and a fourth generation (4G), a fifth generation (5G), or later generation mobile networks. In an embodiment, the communication transceiver 11 is configured to transmit or receive data through a network 30 (for example, the Internet, a local area network, or other types of networks).

The storage 13 may be any types of fixed or removable random access memory (RAM), a read only memory (ROM), a flash memory, a conventional hard disk drive (HDD), a solid-state drive (SSD), or similar components. In an embodiment, the storage 13 is configured to store a program code, a software module, a configuration, data (for example, a sound signal, a watermark pattern, and a watermark sound signal, etc.), or a file.

The processor 15 is coupled to the communication transceiver 11 and the storage 13. The processor 15 may be a central processing unit (CPU), a graphic processing unit (GPU), other programmable general-purpose or special-purpose microprocessors, a digital signal processor (DSP), a programmable controller, a field programmable gate array (FPGA), an application-specific integrated circuit (ASIC), other similar components, or a combination of the above. In an embodiment, the processor 15 is configured to perform all or a part of operations of the transmitting device 10, and may load and execute the software module, the program code, the file, and the data stored by the storage 13.

The receiving device 50 includes (but is not limited to) a communication transceiver 51, a storage 53, and a processor 55. Implementation aspects of the communication transceiver 51, the storage 53, and the processor 55 and functions thereof may respectively refer to the descriptions of the communication transceiver 11, the storage 13, and the processor 15. Thus, details in this regard will not be further reiterated in the following.

In some embodiments, the transmitting device 10 and/or the receiving device 50 further includes a sound receiver and/or a speaker (not shown). The sound receiver may be a dynamic, condenser, or electret condenser microphone. The sound receiver may also be a combination of other electronic components that may receive a sound wave (for example, human voice, environmental sound, and machine operation sound, etc.) and convert the sound wave into a sound signal, an analog-to-digital converter, a filter, and an audio processor. In an embodiment, the sound receiver is configured to receive/record a talker to obtain a speech signal. In some embodiments, the speech signal may include a voice of the talker, a sound from the speaker, and/or other environmental sounds. The speaker may be a horn or loudspeaker. In an embodiment, the speaker is configured to play the sound.

Hereinafter, various devices, components, and modules in the speech communication system 1 will be used to illustrate a method according to the embodiment of the disclosure. Each of the processes of the method may be adjusted accordingly according to the implementation situation, and the disclosure is not limited thereto.

Figure 2:
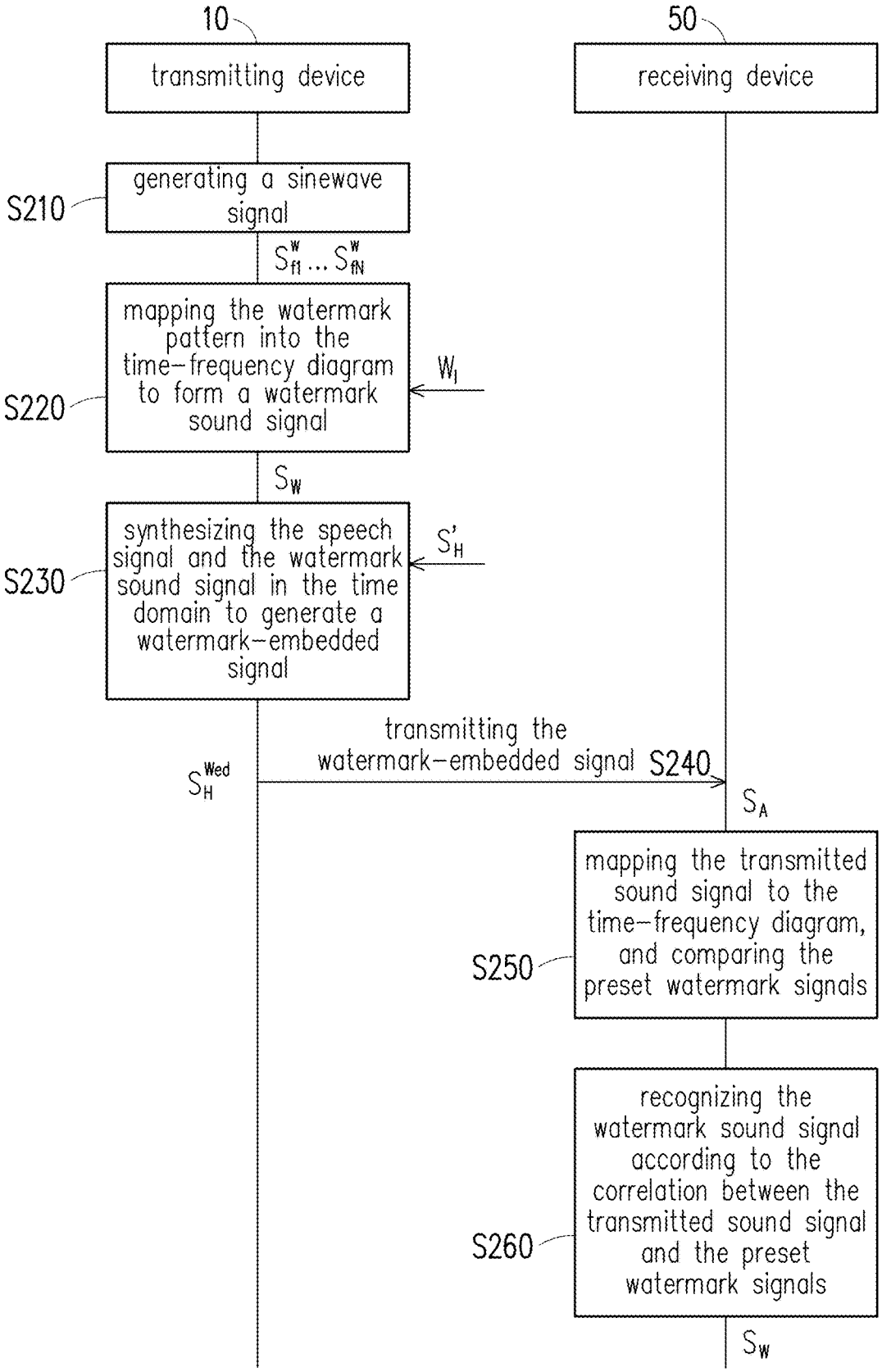
FIG. 2 is a flowchart of a processing method of a sound watermark according to an embodiment of the disclosure.
Figure 3A:
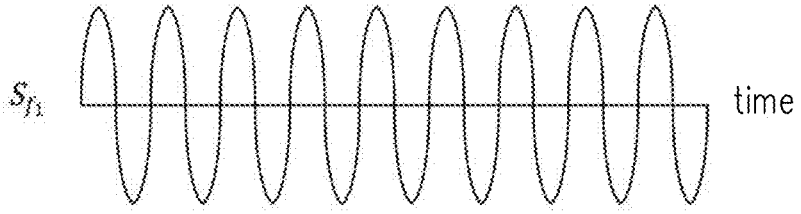
FIGS. 3A and 3B are diagrams of waveforms of sinewave signals with different frequencies.
Figure 3B:
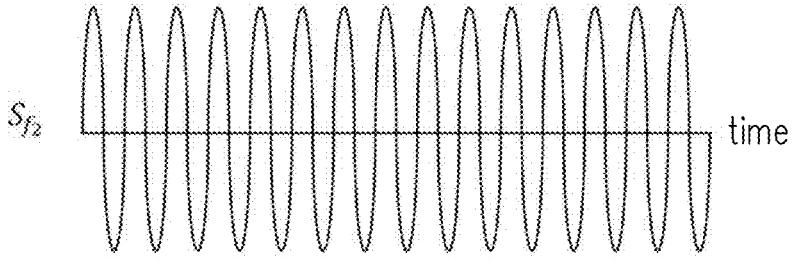

FIG. 2 is a flowchart of a processing method of a sound watermark according to an embodiment of the disclosure. Referring to FIG. 2, the processor 15 of the transmitting device 10 generates one or more sinewave signals $S_{f1}$ to $S_{fN}$ (step S210). Specifically, frequencies of the sinewave signals (for example, a sine wave or a cosine wave) are different. For example, FIGS. 3A and 3B are diagrams of waveforms of the sinewave signals $S_{f1}$ and $S_{f2}$ with different frequencies. Referring to FIGS. 3A and 3B, the frequency of the sinewave signal $S_{f2}$ is higher than that of the sinewave signal $S_{f1}$. It is assumed that there are N sinewave signals $S_{f1}$ to $S_{fN}$, that is, N sinewave signals $S_{f1}$ to $S_{fN}$ with different frequencies. N is, for example, 32, 64, 128, or other positive integers.

In an embodiment, the processor 15 may decide the frequency of one of the sinewave signals $S_{f1}$ to $S_{fN}$ every specific frequency spacing. For example, the frequency of the sinewave signal $S_{f1}$ is 16 kilohertz (kHz). The frequency of the sinewave signal $S_{f2}$ is 16.5 kHz. The frequency of the sinewave signal Sn is 17 kHz. That is, the frequency spacing is 500 Hz, and the rest may be derived by analogy. In another embodiment, the frequency spacing between the sinewave signals $S_{f1}$ to $S_{fN5}$ may not be fixed.

The processor 15 sets a time length of the sinewave signals $S_{f1}$ to $S_{fN}$ to the number of samples of an audio frame (time unit) (for example, 512, 1024, or 2028). In addition, the sinewave signals belong to a high-frequency sound signal (for example, the frequency thereof is between 16 kHz and 20 kHz, but may vary depending on capabilities of the speaker).

In an embodiment, the processor 15 further windows the sinewave signals $S_{f1}$ to $S_{fN}$ based on a windowing function (for example, a Hamming window, a rectangular window, or a Gaussian window) to generate windowed sinewave signals $S_{f1}^{w}$ to $S_{fN}^{w}$. In this way, a time spacing is generated in a time domain between the adjacent audio frames, and a pulse is avoided between the audio frames.

Figure 4A:
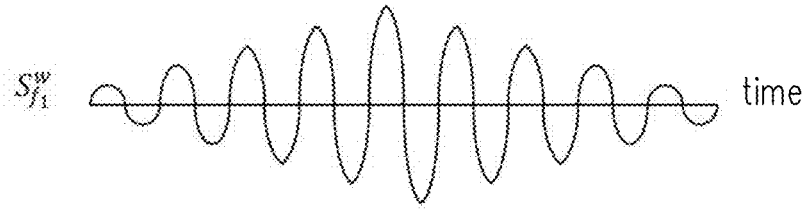
FIGS. 4A and 4B are diagrams of the windowed waveforms of the sinewave signals of FIGS. 3A and 3B.
Figure 4B:
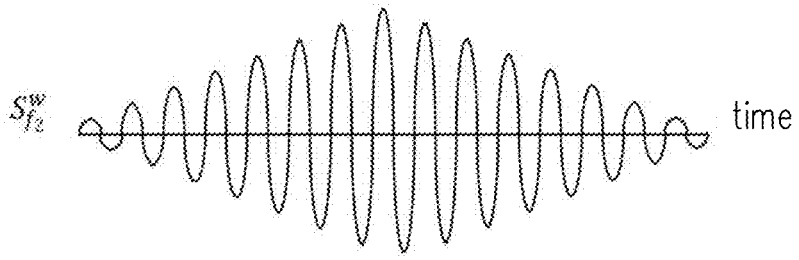

For example, FIGS. 4A and 4B are diagrams of the windowed waveforms of the sinewave signals of FIGS. 3A and 3B. Referring to FIG. 4A, the sinewave signal $S_{f1}$ becomes $S_{f1}^{w}$ after being windowed. Referring to FIG. 4B, the sinewave signal $S_{f2}$ becomes $S_{f2}^{w}$ after being windowed.

Figure 5A:
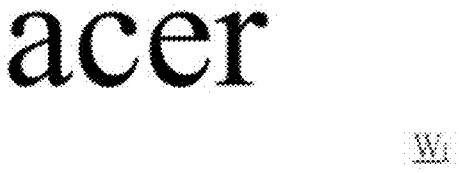
FIG. 5A is an example of a watermark pattern.

The processor 15 maps a watermark pattern $W_1$ into a time-frequency diagram to form a watermark sound signal $S_W$ (step S220). Specifically, the watermark pattern $W_1$ may be designed according to the user requirements, and the embodiment of the disclosure is not limited thereto. For example, FIG. 5A is an example of the watermark pattern $W_1$. Referring to FIG. 5A, the watermark pattern $W_1$ is formed by a text "acer".

Figure 5B:
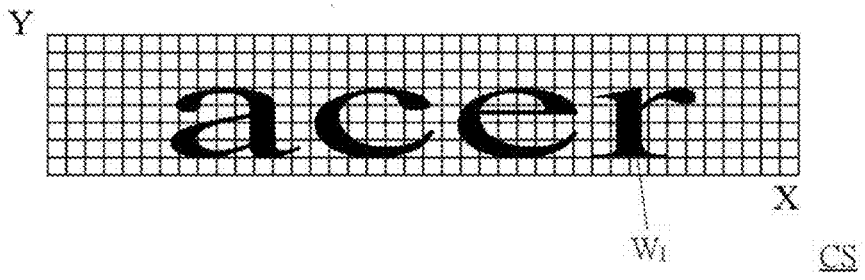
FIG. 5B is an example of a watermark pattern in a two-dimensional coordinate system.

The processor 15 converts the watermark pattern $W_1$ from a two-dimensional coordinate system into the time-frequency diagram. The two-dimensional coordinate system includes two dimensions. For example, FIG. 5B is an example of the watermark pattern $W_1$ in a two-dimensional coordinate system CS. Referring to FIG. 5B, the two dimensions include a horizontal axis X and a vertical axis Y. That is to say, any position on the two-dimensional coordinate system CS may use a distance from the horizontal axis X and a distance from the vertical axis Y to define a coordinate.

In an embodiment, the processor 15 further extends the watermark pattern $W_1$ on a time axis corresponding to one dimension in the two-dimensional coordinate system according to an amount of superposition. The amount of superposition is related to an amount of superposition of the adjacent audio frames. For example, the amount of superposition is 0.5 audio frame or other time lengths, and the superposition of the audio frame will be detailed later. Taking FIGS. 5A and 5B as an example, assuming that the amount of superposition is 0.5 audio frame, and the horizontal axis X corresponds to the time axis in the time-frequency diagram, the watermark pattern $W_1$ extends by two times along a direction of the horizontal axis X. In other words, a multiple of extending the watermark pattern $W_1$ is inversely proportional to the amount of superimposition.

On the other hand, the time-frequency diagram includes a time axis and a frequency axis. Each of the audio frames on the time axis corresponds to the sinewave signals with different frequencies on the frequency axis. In an embodiment, the processor 15 establishes a watermark matrix in the time-frequency diagram according to the watermark pattern $W_1$. The watermark matrix includes multiple elements, and each of the elements is one of a marked element and an unmarked element. The marked element denotes that a corresponding position of the watermark pattern $W_1$ in the two-dimensional coordinate system has a value, and the unmarked element denotes that the corresponding position of the watermark pattern $W_1$ in the two-dimensional coordinate system does not have a value.

Taking FIG. 5B as an example, the two-dimensional coordinate system CS is divided into 40*8 grids. If there is a watermark pattern $W_1$ on an intersection of any vertical lines and horizontal lines (where a coordinate may be formed in the two-dimensional coordinate system CS), it indicates that there is a value at the position. If there is no watermark pattern $W_1$, it indicates that there is not a value at this position.

Figure 5C:
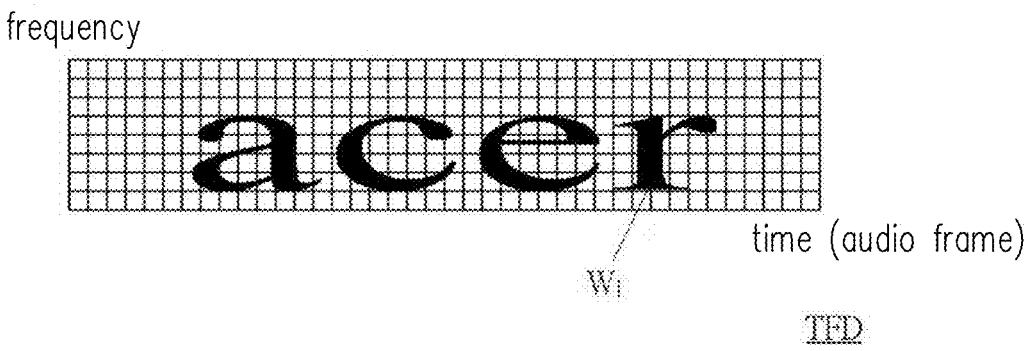
FIG. 5C is an example of the watermark pattern of FIG. 5B mapped into a time-frequency diagram.

FIG. 5C is an example of the watermark pattern $W_1$ of FIG. 5B mapped into a time-frequency diagram TFD. Referring to FIG. 5C, similarly, the time-frequency diagram TFD may also be divided into 40*8 grids. The processor 15 compares the two-dimensional coordinate system CS and the time-frequency diagram TFD, and accordingly defines the watermark matrix in the time-frequency diagram TFD as the marked element or the unmarked element.

The processor 15 selects the one or more sinewave signals in each of the audio frames according to the watermark matrix. The one or more selected sinewave signals correspond to the marked elements in the elements. Taking FIG. 5C as an example, each of the vertical lines on the time axis denotes one audio frame. In addition, each of the horizontal lines on the frequency axis denotes one sinewave signal with a certain frequency. For example, the lowermost horizontal line corresponds to the sinewave signal with a frequency of 16 kHz, and the horizontal line thereon corresponds to the sinewave signal with a frequency of 16.2 kHz. The rest may be derived by analogy. The processor 15 may record a corresponding relationship between each of the horizontal lines on the frequency axis and the frequencies of the sinewave signals. For each of the audio frames on the time axis, the processor 15 determines whether there is a marked element in the watermark matrix, and selects the sinewave signal according to the corresponding relationship.

Figure 5D:
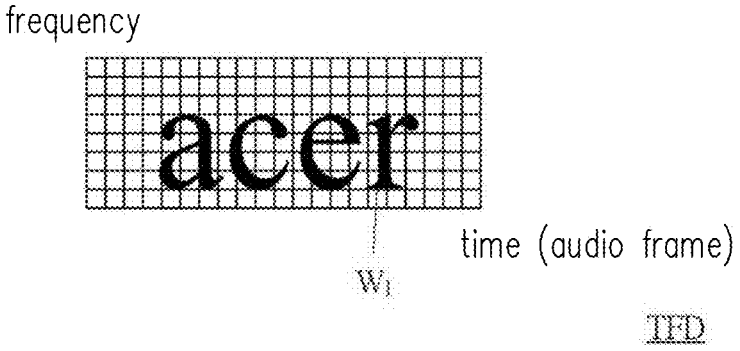
FIG. 5D is a schematic diagram of an example of multiple audio frames after superimposition.

The processor 15 superimposes the one or more selected sinewave signals on the audio frames in the time-frequency diagram in the time domain to form the watermark sound signal $S_W$. The processor 15 superimposes the adjacent audio frames according to the amount of superimposition. For example, FIG. 5D is a schematic diagram of an example of multiple audio frames after superimposition. Referring to FIG. 5D, the sinewave signal on the first audio frame overlaps the sinewave signal on the second audio frame by 0.5 sound frame, and the rest may be derived by analogy. In addition, compared with FIG. 5C, the watermark pattern $W_1$ in FIG. 5D is reduced by one time in a direction of the time axis.

Figure 6:
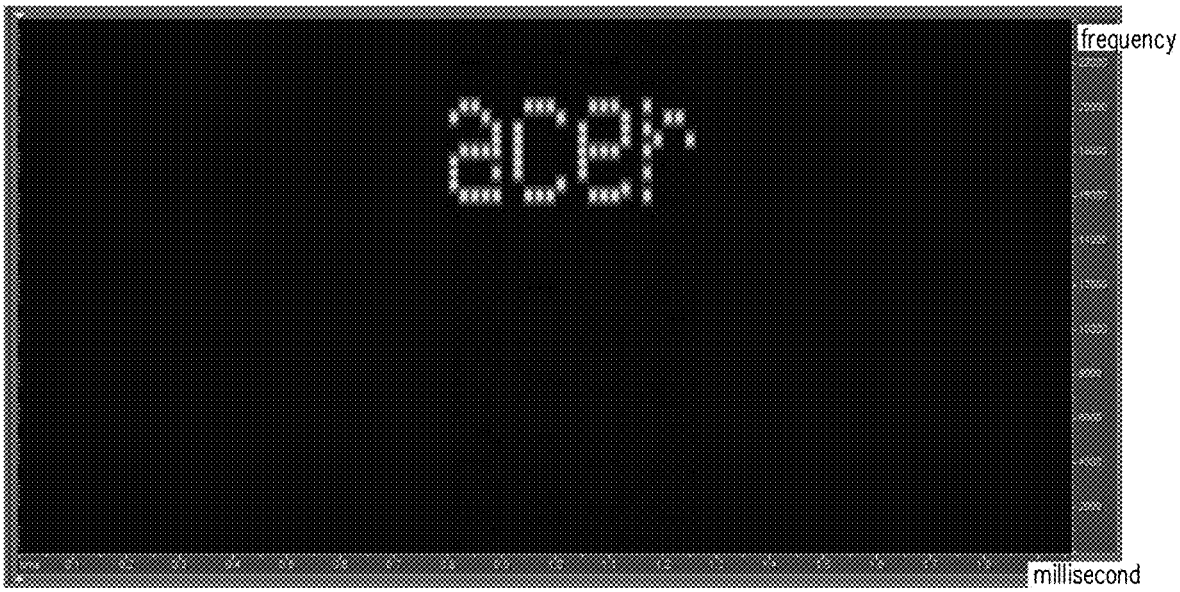
FIG. 6 is an example of a watermark sound signal in a time-frequency diagram.

FIG. 6 is an example of a watermark sound signal in a time-frequency diagram. Referring to FIG. 6, the watermark pattern $W_1$ of FIG. 5A is formed on a checkered diagram.

The processor 15 synthesizes a speech signal S'H and the watermark sound signal $S_W$ in the time domain to generate a watermark-embedded signal $S_H^{Wed}$ (step S230). Specifically, a speech signal $S_H$ is a sound signal obtained by the transmitting device 10 recording the talker through the sound receiver, or obtained from an external device (for example, a call conference server, a recording pen, or a smart phone). For example, in a conference call, the transmitting device 10 receives the sound of the talker.

In an embodiment, the processor 15 may filter out the sound signals in a frequency band where the sinewave signals $S_{f1}$ to $S_{fN}$ are located in the original speech signal $S_H$ to generate the speech signal $S'_H$. For example, assuming that the frequency band where the sinewave signals $S_{f1}$ to $S_{fN}$ are located is 16 kHz to 20 kHz, the processor 15 passes the speech signal $S_H$ through a low-pass filter that is passable below 16 kHz. In this way, it is possible to prevent the speech signal $S_H$ from affecting the watermark sound signal $S_W$. In another embodiment, the processor 15 may directly use the original speech signal $S_H$ as the speech signal $S'_H$.

The processor 15 may add the watermark sound signal $S_W$ to the speech signal $S'_H$ in the time domain through methods such as spread spectrum, echo hiding, and phase encoding to form the watermark-embedded signal $S_H^{Wed}$. In light of the above, in the embodiment of the disclosure, the watermark sound signal $S_W$ is established in advance to be synthesized with the speech signal $S'_H$ in the time domain in real time.

Figure 7:
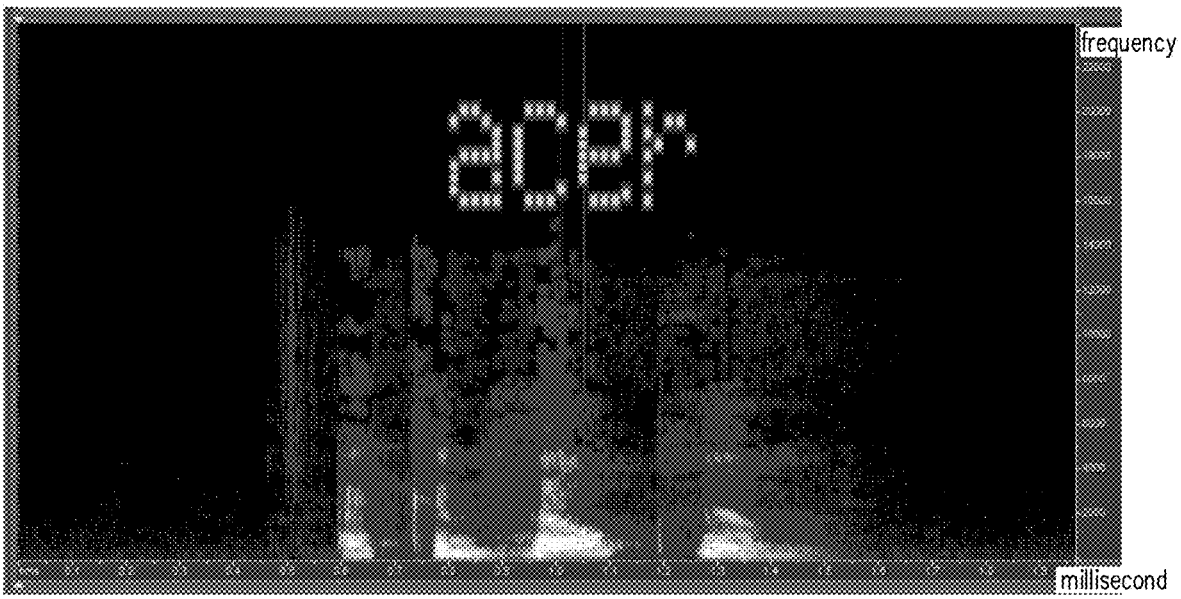
FIG. 7 is an example of a transmitted sound signal in a time-frequency diagram.

The processor 15 transmits the watermark-embedded signal $S_H^{Wed}$ through the communication transceiver 11 and through the network 30 (step S240). The processor 55 of the receiving device 50 receives a transmitted sound signal $S_A$ through the communication transceiver 51. The transmitted sound signal $S_A$ is the transmitted watermark-embedded signal $S_H^{Wed}$ In some cases, the watermark-embedded signal $S_H^{Wed}$ is distorted during the transmission of the network 30 (for example, interfered by other environmental sounds, reflections from obstacles, or other noise) to form the transmitted sound signal $S_A$ (or called an attacked signal). It is worth noting that the transmitting device 10 sets the watermark sound signal $S_W$ to the high-frequency sound signal, but the high-frequency sound signal may be interfered by a pulse signal. For example, FIG. 7 is an example of the transmitted sound signal $S_A$ in the time-frequency diagram. Referring to FIG. 7, a signal vertically extending from a low frequency to a high frequency at about 1.05 seconds in the figure is the pulse signal, and the pulse signal overlaps the watermark sound signal $S_W$, thereby affecting a recognition result of the watermark pattern $W_1$.

The processor 55 maps the transmitted sound signal $S_A$ into the time-frequency diagram, and compares multiple preset watermark signals $W_1$ to $W_M$ (step S250). Specifically, the processor 55 may use a fast Fourier transform (FFT) or other conversions from the time domain to a frequency domain to switch each of the non-superimposed audio frames in the transmitted sound signal $S_A$ to the frequency domain, and consider the overall time-frequency diagram formed by all the audio frames.

On the other hand, the preset watermark signals $W_1$ to $W_M$ (where M is a positive integer) are respectively configured to recognize different transmitting devices 10 or different users. The preset watermark signals have been stored in the storage 53. The preset watermark signals $W_1$ to $W_M$ correspond to multiple preset watermark patterns in the two-dimensional coordinate system. Similarly, each of the preset watermark patterns may be designed according to the user requirements, and the embodiment of the disclosure is not limited thereto.

The processor 55 recognizes the watermark sound signal $S_W$ (step S260) according to a correlation between the transmitted sound signal $S_A$ and the preset watermark signals $W_1$ to $W_M$ (that is, a comparison result of the transmitted sound signal $S_A$ and the preset watermark signals $W_1$ to $W_M$). Specifically, the correlation herein is a degree of similarity between the transmitted sound signal $S_A$ and the preset watermark signals $W_1$ to $W_M$. In the preset watermark signals, the preset watermark signal with the highest degree of similarity is the watermark sound signal $S_W$.

Figure 8:
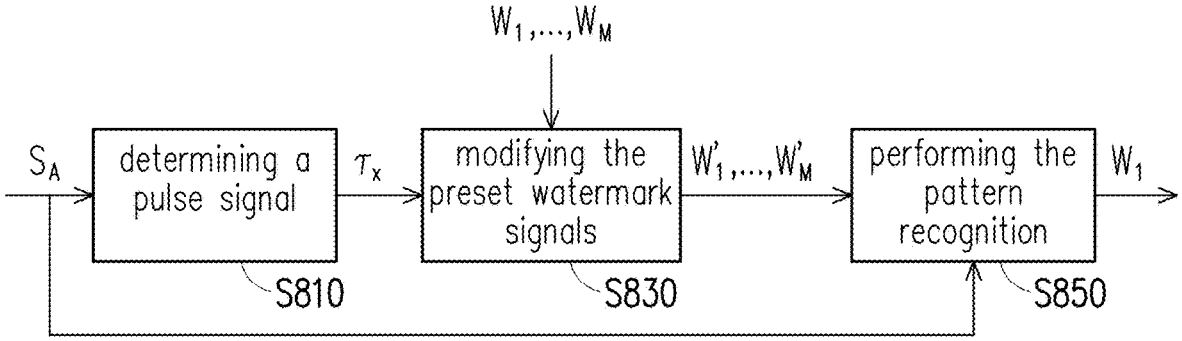
FIG. 8 is a flowchart of a watermark pattern recognition according to an embodiment of the disclosure.

FIG. 8 is a flowchart of a watermark pattern recognition according to an embodiment of the disclosure. Referring to FIG. 8, the processor 55 determines one or more pulse signals $\tau_x$ in the transmitted sound signal $S_A$ (step S810). Specifically, a characteristic of the pulse signal $\tau_x$ is that all frequencies have interference signals in a short period of time. In an embodiment, the processor 55 may determine a power of the transmitted sound signal $S_A$ at the frequencies in each of the audio frames in the time-frequency diagram, and determine that in the audio frames, the audio frame having the power with the frequencies greater than a threshold value is the pulse signal $\tau_x$. For example, the processor 55 may determine whether the power at all frequencies of the certain audio frame is greater than the set threshold value. If such condition is met (that is, the power at all frequencies is greater than the threshold value), the processor 55 may determine that the audio frame is interfered by the pulse signal $\tau_x$. In some embodiments, the processor 55 may select specific frequencies (instead of all the frequencies) in a frequency spectrum, and determine whether the power at the frequencies is greater than the threshold.

The processor 55 may modify the preset watermark signals $W_1$ to $W_M$ according to the one or more pulse signals $\tau_x$ (step S830). Specifically, the processor 55 adds or subtracts a characteristic of pulse interference to the preset watermark signals $W_1$ to $W_M$ on the vertical axis (corresponding to the frequency axis) in the two-dimensional coordinate system according to a position of the audio frame where the pulse signal $\tau_x$ is located (corresponding to a position in the horizontal axis in the two-dimensional coordinate system), so as to generate modified preset watermark signals $W'_1$ to $W'_M$.

Figure 9:
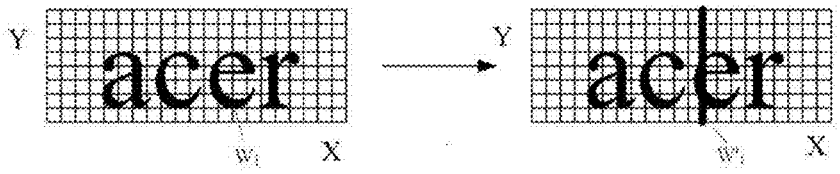
FIG. 9 is a schematic diagram of an example of modifying a preset watermark signal.

For example, FIG. 9 is a schematic diagram of an example of modifying the preset watermark signal $W_1$. Referring to FIG. 9, for a position on the X axis, the processor 55 adds a linear pattern of vertical line (that is, the characteristic of pulse interference) at each of the positions on the Y axis to form the modified preset watermark signal W'1.

In an embodiment, the above correlation includes a first correlation. The processor 55 may determine the first correlation between the transmitted sound signal $S_A$ and the preset watermark signals $W_1$ to $W_M$ that have not been modified, and select multiple candidate watermark signals from the preset watermark signals $W_1$ to $W_M$ according to the first correlation. The processor 55 may only modify the candidate watermark signals in the preset watermark signals $W_1$ to $W_M$. The processor 55 may, for example, filter out some candidate watermark signals with a relatively high degree of similarity to the transmitted sound signal $S_A$ according to a classifier based on deep learning or cross-correlation. Taking cross-correlation as an example, a cross-correlation value thereof greater than the corresponding threshold value may be used as the candidate watermark signal.

In an embodiment, the above correlation includes a second correlation. The processor 55 may decide the second correlation between the transmitted sound signal $S_A$ and the modified preset watermark signals $W_1$ to $W_M$ or the candidate watermark signals, and perform a pattern recognition accordingly (step S850). Specifically, since the watermark sound signal $S_W$ belongs to the high-frequency audio signal, the processor 55 may filter out the sound signals outside the frequency band where the sinewave signals $S_{f1}$ to $S_{fN}$ are located in the original transmitted sound signal $S_A$. For example, the processor 55 passes the transmitted sound signal $S_A$ through a high-pass filter that is passable above 16 kHz. In addition, the processor 55 may, for example, filter out one candidate watermark signal with the highest degree of similarity to the transmitted sound signal $S_A$ according to the classifier based on deep learning or cross-correlation. Taking the cross-correlation as an example, the maximum cross-correlation value thereof may be used as the recognized watermark sound signal $S_W$. For example, the preset watermark signal $W_1$ has the highest correlation, so that the preset watermark signal $W_1$ is the watermark sound signal $S_W$.

Based on the above, in the speech communication system and the processing method of the sound watermark according to the embodiments of the disclosure, the watermark sound signal formed by superimposing the sinewave signals with different frequencies corresponding to the audio frames is defined in advance at a transmitting end, so that the watermark sound signal may be embedded into the speech signal in real time, thereby meeting the needs of real-time call conferences. In addition, the pulse signal is determined at a receiving end, and the interference of the pulse signal on the preset watermark signals is considered, so that the watermark sound signal is accurately recognized, thereby reducing the noise impact of the pulse signal.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A processing method of a sound watermark, comprising:

generating, through a transmitting device, a plurality of sinewave audio signals, wherein frequencies of the sinewave audio signals are different, and the sinewave audio signals belong to a high-frequency sound signal;

converting, through the transmitting device, a watermark pattern into a time-frequency diagram to form a watermark sound signal, wherein two dimensions of the watermark pattern in a two-dimensional coordinate system respectively correspond to a time axis and a frequency axis in the time-frequency diagram, and each of a plurality of audio frames on the time axis corresponds to the sinewave audio signals with different frequencies on the frequency axis;

embedding, through the transmitting device, the watermark sound signal into a speech signal recorded by a sound receiver in a time domain to generate a watermark-embedded signal;

transmitting, through the transmitting device, the watermark-embedded signal via a network;

receiving, through a receiving device, a transmitted sound signal via the network, wherein the transmitted sound signal is the transmitted watermark-embedded signal;

converting, through a receiving device, the transmitted sound signal into the time-frequency diagram, and comparing a plurality of preset watermark signals, wherein the preset watermark signals correspond to a plurality of preset watermark patterns in the two-dimensional coordinate system, and comparing the plurality of preset watermark signals comprises:

determining at least one pulse signal in the transmitted sound signal;

modifying the preset watermark signals according to the at least one pulse signal; and deciding a first correlation between the transmitted sound signal and the modified preset watermark signals; and recognizing, through a receiving device, the watermark sound signal according to a correlation between the transmitted sound signal and the preset watermark signals, wherein the correlation is a degree of similarity between the transmitted sound signal and the preset watermark signals, the correlation comprises the first correlation, and in the preset watermark signals, the preset watermark signal with the highest degree of similarity is the watermark sound signal.

2. The processing method of the sound watermark according to claim 1, wherein mapping the watermark pattern into the time-frequency diagram to form the watermark sound signal comprises:

establishing a watermark matrix in the time-frequency diagram according to the watermark pattern, wherein the watermark matrix comprises a plurality of elements, each of the elements is one of a marked element and an unmarked element, the marked element denotes that a corresponding position of the watermark pattern in the two-dimensional coordinate system has a value, and the unmarked element denotes that the corresponding position of the watermark pattern in the two-dimensional coordinate system does not have a value;

selecting at least one of the sinewave audio signals in each of the audio frames according to the watermark matrix, wherein at least one selected sinewave audio signal corresponds to the marked element in the elements; and superimposing the at least one selected sinewave audio signal in the audio frames in the time domain to form the watermark sound signal.

3. The processing method of the sound watermark according to claim 2, wherein establishing the watermark matrix in the time-frequency diagram according to the watermark pattern comprises:

extending the watermark pattern according to an amount of superimposition corresponding to a dimension in the two-dimensional coordinate system on the time axis, wherein the amount of superimposition is related to an amount of superimposition of superimposing the adjacent audio frames.

4. The processing method of the sound watermark according to claim 1, wherein synthesizing the speech signal and the watermark sound signal comprises:

filtering out a sound signal in a frequency band where the sinewave audio signals are located in the speech signal.

5. The processing method of the sound watermark according to claim 1, wherein generating the sinewave audio signals comprises:

setting a time length of the sinewave audio signals to the one audio frame; and windowing the sinewave audio signals.

6. The processing method of the sound watermark according to claim 1, wherein the correlation comprises a second correlation, and before modifying the preset watermark signals according to the at least one pulse signal, the method further comprises:

determining the second correlation between the transmitted sound signal and the preset watermark signals that have not been modified; and selecting a plurality of candidate watermark signals from the preset watermark signals according to the second correlation, wherein only the candidate watermark signals in the preset watermark signals are modified.

7. The processing method of the sound watermark according to claim 1, wherein determining the at least one pulse signal in the transmitted sound signal comprises:

determining a power of the transmitted sound signal at a plurality of frequencies in each of the audio frames in the time-frequency diagram; and determining that in the audio frames, the audio frame having the power of the frequencies greater than a threshold value is the one pulse signal.

8. The processing method of the sound watermark according to claim 1, wherein modifying the preset watermark signals comprises:

adding a characteristic of pulse interference to the preset watermark signals on a dimension corresponding to the frequency axis in the two-dimensional coordinate system according to a position of the audio frame where the at least one pulse signal is located.

9. A speech communication system, comprising:

a transmitting device configured for:

generating a plurality of sinewave audio signals, wherein frequencies of the sinewave audio signals are different, and the sinewave audio signals belong to a high-frequency sound signal;

converting a watermark pattern into a time-frequency diagram to form a watermark sound signal, wherein two dimensions of the watermark pattern in a two-dimensional coordinate system respectively correspond to a time axis and a frequency axis in the time-frequency diagram, and each of a plurality of audio frames on the time axis corresponds to the sinewave audio signals with different frequencies on the frequency axis;

embedding the watermark sound signal into a speech signal recorded by a sound receiver in a time domain to generate a watermark-embedded signal; and transmitting the watermark-embedded signal via a network; and a receiving device configured for:

receiving a transmitted sound signal via the network, wherein the transmitted sound signal is the transmitted watermark-embedded signal;

converting the transmitted sound signal into the time-frequency diagram, and comparing a plurality of preset watermark signals, wherein the preset watermark signals correspond to a plurality of preset watermark patterns in the two-dimensional coordinate system; and recognizing the watermark sound signal according to a correlation between the transmitted sound signal and the preset watermark signals, wherein the correlation is a degree of similarity between the transmitted sound signal and the preset watermark signals, and in the preset watermark signals, the preset watermark signal with the highest degree of similarity is the watermark sound signal, the correlation comprises a first correlation, and the receiving device is further configured for:

determining at least one pulse signal in the transmitted sound signal;

modifying the preset watermark signals according to the at least one pulse signal; and deciding the first correlation between the transmitted sound signal and the modified preset watermark signals.

10. The speech communication system according to claim 9, wherein the transmitting device is further configured for:

establishing a watermark matrix in the time-frequency diagram according to the watermark pattern, wherein the watermark matrix comprises a plurality of elements, each of the elements is one of a marked element and an unmarked element, the marked element denotes that a corresponding position of the watermark pattern in the two-dimensional coordinate system has a value, and the unmarked element denotes that the corresponding position of the watermark pattern in the two-dimensional coordinate system does not have a value;

selecting at least one of the sinewave audio signals in each of the audio frames according to the watermark matrix, wherein at least one selected sinewave audio signal corresponds to the marked element in the elements; and superimposing the at least one selected sinewave audio signal in the audio frames in the time domain to form the watermark sound signal.

11. The speech communication system according to claim 10, wherein the transmitting device is further configured for:

extending the watermark pattern according to an amount of superimposition corresponding to a dimension in the two-dimensional coordinate system on the time axis, wherein the amount of superimposition is related to an amount of superimposition of superimposing the adjacent audio frames.

12. The speech communication system according to claim 9, wherein the transmitting device is further configured for:

filtering out a sound signal in a frequency band where the sinewave audio signals are located in the speech signal.

13. The speech communication system according to claim 9, wherein the transmitting device is further configured for:

setting a time length of the sinewave audio signals to the one audio frame; and windowing the sinewave audio signals.

14. The speech communication system according to claim 9, wherein the correlation comprises a second correlation, and the receiving device is further configured for:

determining the second correlation between the transmitted sound signal and the preset watermark signals that have not been modified; and selecting a plurality of candidate watermark signals from the preset watermark signals according to the second correlation, wherein only the candidate watermark signals in the preset watermark signals are modified.

15. The speech communication system according to claim 9, wherein the receiving device is further configured for:

determining a power of the transmitted sound signal at a plurality of frequencies in each of the audio frames in the time-frequency diagram; and determining that in the audio frames, the audio frame having the power of the frequencies greater than a threshold value is the one pulse signal.

16. The speech communication system according to claim 9, wherein the receiving device is further configured for:

adding a characteristic of pulse interference to the preset watermark signals on a dimension corresponding to the frequency axis in the two-dimensional coordinate system according to a position of the audio frame where the at least one pulse signal is located.

* * * * *